US008256990B2

(12) United States Patent
Koerner

(10) Patent No.: US 8,256,990 B2
(45) Date of Patent: Sep. 4, 2012

(54) DRAINAGE UNIT WITH EXTERNAL COVERING AND METHOD FOR MANUFACTURE

(75) Inventor: Dennis W. Koerner, Memphis, TN (US)

(73) Assignee: EZFlow, L.P., Old Saybrook, CT (US)

( * ) Notice: Subject to any disclaimer, the term of this patent is extended or adjusted under 35 U.S.C. 154(b) by 297 days.

(21) Appl. No.: 11/562,199

(22) Filed: Nov. 21, 2006

(65) Prior Publication Data

US 2007/0166106 A1 Jul. 19, 2007

Related U.S. Application Data

(60) Provisional application No. 60/759,137, filed on Jan. 13, 2006.

(51) Int. Cl.
*E02B 11/00* (2006.01)

(52) U.S. Cl. ..... 405/45; 405/36

(58) Field of Classification Search ..... 405/36, 405/43, 45, 50, 302.6, 302.7
See application file for complete search history.

(56) References Cited

U.S. PATENT DOCUMENTS

| | | | | |
|---|---|---|---|---|
| 3,403,519 | A * | 10/1968 | Balko | 405/45 |
| 3,441,140 | A | 4/1969 | Thurber | |
| 4,104,774 | A | 8/1978 | Overmyer et al. | |
| 4,182,581 | A | 1/1980 | Uehara et al. | |
| 5,015,123 | A | 5/1991 | Houck et al. | |
| 5,100,258 | A | 3/1992 | VanWagoner | |
| 5,378,357 | A * | 1/1995 | Houck et al. | 210/170.08 |
| 5,466,092 | A | 11/1995 | Semenza | |
| 6,126,362 | A * | 10/2000 | Carter et al. | 405/114 |
| 6,173,483 | B1 | 1/2001 | Weaver et al. | |
| 6,303,033 | B1 | 10/2001 | Malone | |
| 6,315,493 | B2 | 11/2001 | Malone et al. | |
| 6,443,652 | B1 | 9/2002 | Houck et al. | |
| 6,705,800 | B2 | 3/2004 | Ring et al. | |
| 6,854,924 | B2 | 2/2005 | Ring | |
| 6,857,818 | B2 | 2/2005 | Bussey | |
| 6,988,852 | B2 | 1/2006 | Bussey, Jr. et al. | |
| 2003/0228194 | A1 * | 12/2003 | Ring et al. | 405/46 |
| 2004/0022973 | A1 | 2/2004 | Bussey, Jr. et al. | |
| 2004/0057797 | A1 | 3/2004 | Ring | |
| 2005/0025582 | A1 * | 2/2005 | Ianniello | 405/302.4 |
| 2006/0280557 | A1 | 12/2006 | Ring | |

FOREIGN PATENT DOCUMENTS

| | | | |
|---|---|---|---|
| EP | 1464761 | A | 10/2004 |
| GB | 2016109 | | 9/1979 |
| JP | 402136418 | * | 5/1990 |

OTHER PUBLICATIONS

"Letter from Wisconsin Department of Commerce to Ring Industrial Group", dated Nov. 21, 2003.
"Wisconsin Department of Commerce—Register, Tables 84.30-11 and 84.30-12", Register No. 587, p. 203, Nov. 2004.

(Continued)

*Primary Examiner* — John Kreck
*Assistant Examiner* — Sean Andrish
(74) *Attorney, Agent, or Firm* — C. Nessler

(57) ABSTRACT

Drainage units comprise lightweight aggregate held within a perforated sleeve having an exterior surface, where at least a portion of the exterior surface comprises a barrier material which is substantially impervious to solids.

24 Claims, 12 Drawing Sheets

OTHER PUBLICATIONS

Pankow, Kenneth O. "Evaluation of EEE ZZZ Lay Drain Systems for Use in the State of Florida", Pankow Engineering Co. dated Dec. 17, 1991.

Stewart, Barry "Evaluation of EZflow Brand Drain Fields in Various Golf Course Applications", www.ezflowlp.com/tech_info_test.htm, photographs dated as early as Jul. 19, 2002.

International Association of Plumbing and Mechanical Officials "Bundled Expanded Poly-Styrene Aggregate Units, IAPMO Guide Criteria, IAPMO IGC 276-2010" May 2010.

David Lentz, Declaration, Sep. 3, 2010.

* cited by examiner

DRAINAGE UNIT WITH EXTERNAL COVERING AND METHOD FOR MANUFACTURE

CROSS-REFERENCE

This application claims benefit of priority from pending U.S. Provisional Patent Application Ser. No. 60/759,137, filed Jan. 13, 2006.

FIELD OF THE INVENTION

This invention relates generally to liquid drainage systems. More specifically, the invention relates to aggregate-based liquid drainage systems, such as those used for foundation drainage, landscape drainage, athletic fields, open trenches, French drains, or fields, such as nitrification fields used as discharge points for septic tanks, etc. More particularly, the present invention relates to a novel, flexible, preassembled drainage line unit which is an improvement over the flexible preassembled drainage line units that are the subject of commonly owned U.S. Pat. Nos. 5,015,123; 6,173,483; 6,705,800 and 6,854,924 the contents of which are herein incorporated by reference in their entirety, as if made a part of the present application.

BACKGROUND

Known preassembled drainage line units constitute loose aggregate in the form of lightweight materials, such as polystyrene beads provided in surrounding relationship to a preferably perforated conduit and bound thereto by a perforated sleeve member, such as plastic netting. Known units may or may not comprise the perforated conduit, or pipe, to be completely effective in a selected use, as explained more fully in commonly owned U.S. Pat. No. 6,854,924 (See Col. 1, lines 15-31).

While known preassembled drainage line units have enjoyed commercial success, certain potential performance limitations persist with respect to manufacture and application. For example, depending upon the type of fill placed over the preassembled units, solids, such as sand or dirt may pass, and otherwise infiltrate downward through the exterior cover, such as the plastic or other sleeve binding netting, and into the void areas between adjacent aggregate used to fill the netting sleeve. Such infiltration can clog these adjacent areas and cause an undesirable reduction in fluid flow through the aggregate. In other applications, it is desirable that the preassembled units, which are normally flexible along their length possess greater rigidity along their length. In still other applications it is desirable or beneficial to provide structure as part of such units to promote the growth of microorganisms within the drainage units.

Commonly owned U.S. Pat. No. 6,854,924 discloses the use of a barrier material incorporated into the preassembled unit in an attempt to solve some of the enumerated shortcomings of prior, known devices. As stated above, the '924 patent is incorporated by reference in its entirety as if made part of the present application.

The improved products of the present invention as described below have been developed to overcome the problems associated with the units described in the known prior art and to better fulfill market needs.

SUMMARY OF THE INVENTION

The present invention relates to the improved integration of liquid permeable and non-permeable barriers into the preassembled drainage units that are the subject of U.S. Pat. No. 6,854,924. In particular, the present invention relates to a method for making a drainage unit comprising the steps of closing a forward end of a provided sleeve material, the sleeve material having an exterior, and feeding the sleeve material along a direction of manufacture. An amount of aggregate is fed into the sleeve to substantially fill the space within the sleeve, and a predetermined amount of liquid permeable and non-permeable barrier material is affixed to the exterior of the sleeve.

The present invention further relates to a method for making a drainage unit comprising the steps of closing a forward end of a sleeve material, and feeding the sleeve along a direction of manufacture. An amount of aggregate is fed into the sleeve to substantially fill the space within the sleeve. The aggregate and sleeve comprise a drainage unit having an exterior. A predetermined amount of liquid permeable or non-permeable barrier material is then affixed to the exterior of the drainage unit.

Still further, the present invention relates to an apparatus for making a drainage unit comprising a means for closing a forward end of a provided sleeve material with the sleeve material having an exterior. The apparatus further comprises a means for feeding the sleeve material along a direction of manufacture, a means for feeding an amount of aggregate into the sleeve to substantially fill the space within the sleeve, and a means for affixing a predetermined amount of liquid permeable or non-permeable barrier material to the exterior of the sleeve.

In yet another embodiment, the present invention relates to an apparatus for making a drainage unit comprising a means for closing a forward end of a sleeve material that is preferably fed substantially continuously, a means for feeding the continuous sleeve along a direction of manufacture, and a means for feeding a conduit into the sleeve along with, or in advance of feeding an amount of aggregate into the sleeve to substantially fill the space within the sleeve, between the conduit and the sleeve. The aggregate and sleeve comprise a drainage unit having an exterior, and the apparatus further comprises a means for affixing a predetermined amount of liquid permeable or non-permeable barrier material to the exterior of the drainage unit.

Further, in another embodiment, the present invention relates to a drainage unit comprising a longitudinally extending perforated sleeve having an exterior, an amount of lightweight aggregate contained within the sleeve, and a liquid permeable or non-permeable barrier substantially impervious to solids. If a liquid permeable barrier layer is selected based upon a desired end-use application, it is understood that the liquid permeable barrier will be substantially impervious to solids, but have a desired and preferably predetermined flow through rate for liquids. The selected barrier material has an outer surface and an inner surface. The barrier inner surface is affixed to the sleeve exterior, and at least a portion of said barrier comprises an exterior portion of the drainage unit.

In still another embodiment, the present invention relates to a drainage unit comprising a longitudinally extending perforated sleeve having an exterior surface and an amount of lightweight aggregate contained within the sleeve with the aggregate having an exterior surface. A liquid permeable or non-permeable barrier substantially impervious to solids is provided, with the barrier having an outer surface and an inner surface. The barrier inner surface is affixed to a surface selected from the group consisting of the sleeve exterior surface, the aggregate exterior surface, and a combination thereof. At least a portion of the barrier comprises an exterior portion of the drainage unit.

In a still further embodiment, the present invention relates to a drainage unit and method of manufacture where a first sleeve material is provided and a length of conduit is or is not introduced into the first sleeve. The first sleeve is closed at one end. If the conduit is present, the first sleeve is secured to the end of the conduit that first enters the sleeve leaving one end of the sleeve open to receive an amount of lightweight aggregate to substantially fill the space between the conduit and the first sleeve. The remaining end of the sleeve is fastened to the second end of the conduit and the filled first sleeve is introduced into a second sleeve. At least one of the first and second sleeves comprises an amount of barrier material.

Further objects, advantages and embodiments of the invention will become evident from the reading of the following detailed description of the invention wherein reference is made to the accompanying drawings.

DETAILED DESCRIPTION

As disclosed in U.S. Pat. No. 6,854,924 (the '924 patent) at Col. 4, lines 46-65, the production of the drainage unit with the barrier sheet material placed between the sleeve netting and the aggregate requires complex retooling of the production line used to manufacture the unit. Such production line alteration is expensive and time consuming, as barrier sheet roll changing and roll replacement complicates a streamlined line production and can inject significant downtime into the production line. Further, the mechanical placement and coverage of the barrier sheet material between the sleeve netting and the aggregate is dependent upon production line restraints. That is, it is difficult to achieve the desired percent barrier coverage desired in one pass to ensure that secure placement of the barrier sheet is achieved between the netting and the aggregate without significant trial and error production waste, in terms of time and material.

Figures 1, 2, 3, 4:
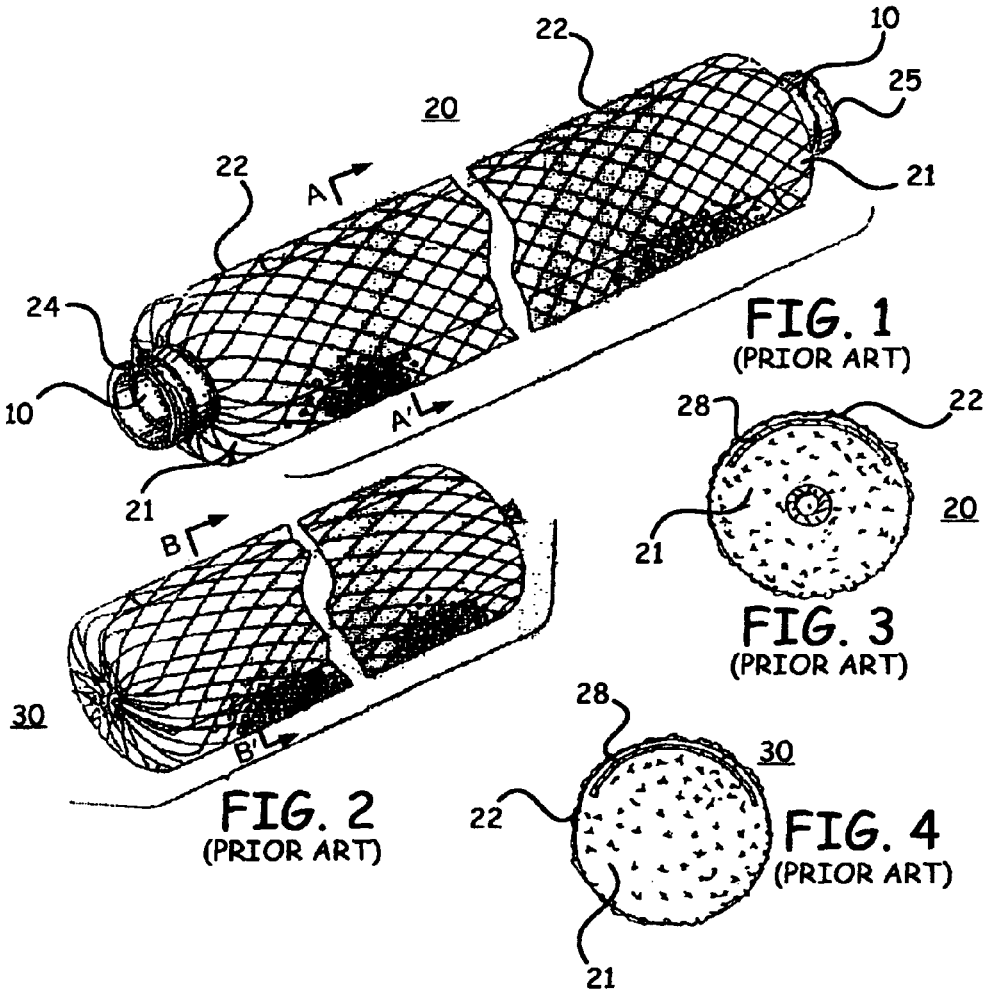
FIG. 1 (PRIOR ART)
FIG. 3 (PRIOR ART)
FIG. 2 (PRIOR ART)
FIG. 4 (PRIOR ART)
FIG. 1 is a perspective side view of a prior art preassembled drainage unit.
FIG. 2 is a perspective side view of another embodiment of a prior art preassembled drainage unit.
FIG. 3 is a cross-sectional view of the embodiment shown in FIG. 1 taken along line A-A'.
FIG. 4 is a cross-sectional view of the embodiment shown in FIG. 2 taken along line B-B'.

FIGS. 1-4 are illustrations of drainage units acknowledged to be Prior Art, and fully described in commonly-owned U.S. Pat. No. 6,854,924, which has been incorporated herein by reference. By way of summary, the present description of FIGS. 1-4 below is provided for clarity and convenience. As shown in FIG. 1 (Prior Art), the longitudinally extending, flexible preassembled drainage line unit 20 includes a centrally disposed perforated conduit 10 encased by an outer perforated sleeve member 22. In one preferred embodiment, the conduit 10 is corrugated and made from a vinyl chloride, preferably polyvinyl chloride. The sleeve member 22 is preferably a tubular netting, preferably made from nylon netting or mesh. The sleeve member 22 is filled with an aggregation of discrete water impervious crush resistant lightweight plastic elements, or aggregate 21 and is secured to the conduit ends 24, 25 by means of a suitable fastener (not distinctly visible) to prevent the escape of loose aggregates 21. As shown, and as explained more fully in the '924 patent, a liquid or water permeable barrier material 28 is shown located covering a portion of the outer area of the unit 20. However, the barrier 28 is located between the sleeve member mesh 22 and the aggregate 21.

FIG. 2 (Prior Art) shows a flexible preassembled drainage unit 30 similar to that shown in FIG. 1, except that, in this embodiment, the unit 30 does not contain a conduit.

FIG. 3 (Prior Art) is a cross-sectional view of the prior art unit embodiment of the unit 20 shown in FIG. 1 (Prior Art) taken along line A-A'. This view clearly depicts the placement of the barrier 28 between the aggregate 21 and the sleeve member 22.

Likewise, FIG. 4 (Prior Art) is a cross-sectional view of the prior art unit embodiment of the unit 30 shown in FIG. 2 (Prior Art) taken along line B-B'. This view clearly depicts the placement of the barrier 28 between the aggregate 21 and the sleeve member 22.

Figure 5:
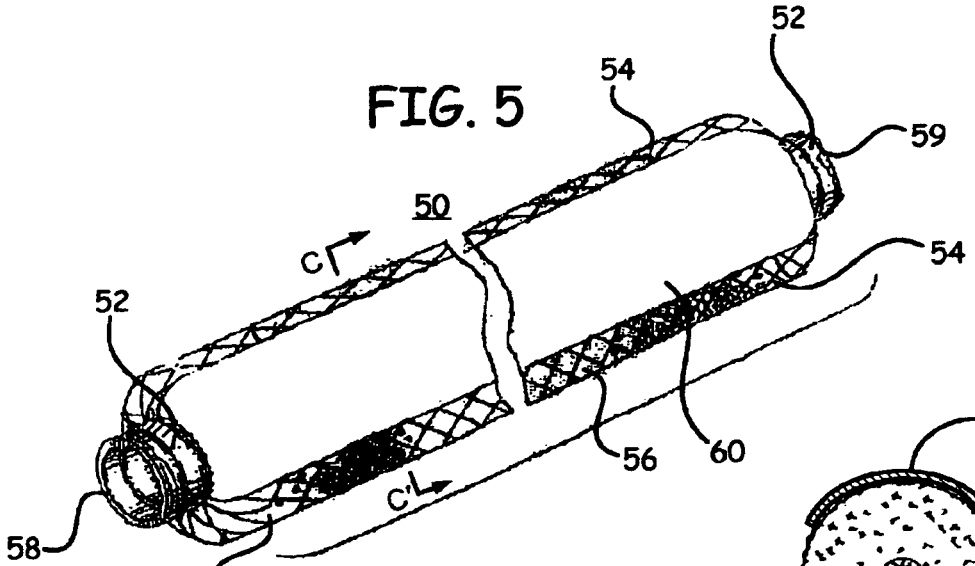
FIG. 5 is a perspective view of one embodiment of a preassembled drainage unit of the present invention.

FIG. 5 shows one embodiment of the present invention. As shown in FIG. 5, the longitudinally extending, flexible preassembled drainage line unit 50 includes a centrally disposed perforated conduit 52 encased by an outer perforated sleeve member 54. In one preferred embodiment, the conduit 52 may or may not be corrugated, and is preferably made from high density polyethylene (HDPE) or poly(vinyl)chloride (PVC), but other suitable polymeric or non-polymeric material may be used to make the conduits, dictated only by the requirements of the desired end use. The sleeve member 54 is preferably a tubular netting, preferably made from plastic netting, such as nylon or mesh of other suitable material. The sleeve member 54 is filled with an aggregation of discrete water impervious crush resistant lightweight plastic element aggregates 56 and is secured to the conduit ends 58, 59 by means of a suitable fastener (not distinctly visible), preventing the escape of loose aggregates 56 as well as preventing undesirable positional sleeve movement. As shown, a liquid permeable or non-permeable barrier material 60 is located covering a portion of the outer area of the unit 50. The barrier 60 is located outside of, and is substantially immobilized, and, preferably affixed to sleeve member 54.

Figure 6:
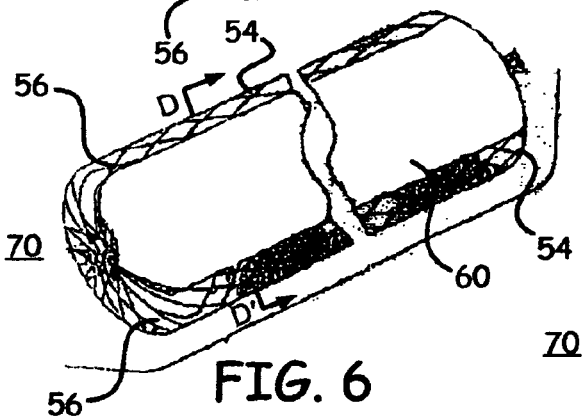
FIG. 6 is a perspective side view of another embodiment of a preassembled drainage unit of the present invention.

FIG. 6 shows another embodiment of the present invention in the form of a flexible preassembled drainage unit 70 similar to that shown in FIG. 5, except that, in this embodiment, the unit 70 does not contain a substantially centrally located conduit that is preferably perforated.

Figure 7:
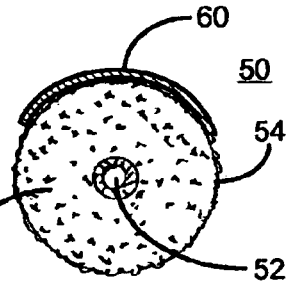
FIG. 7 is a cross-sectional view of the embodiment shown in FIG. 5 taken along line C-C'.

FIG. 7 is a cross-sectional view of the prior art unit shown embodiment of the unit 50 shown in FIG. 5 taken along line C-C'. This view clearly depicts the placement of the barrier 60 outside of the sleeve member 54.

Figure 8:
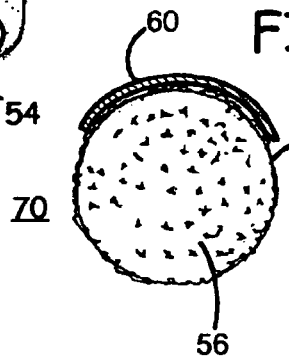
FIG. 8 is a cross-sectional view of the embodiment shown in FIG. 6 taken along line D-D'.

Likewise, FIG. 8 is a cross-sectional view of the embodiment of the present invention showing the unit 70 shown in FIG. 6 taken along line D-D'. This view clearly depicts the placement of the barrier 60 outside of the sleeve member 54.

According to the present invention, the externally placed barrier 60 offers significant advantages for the assembled drainage unit in the field, and, as importantly, offers significant advantages with respect to its manufacture and handling.

Figure 9C:
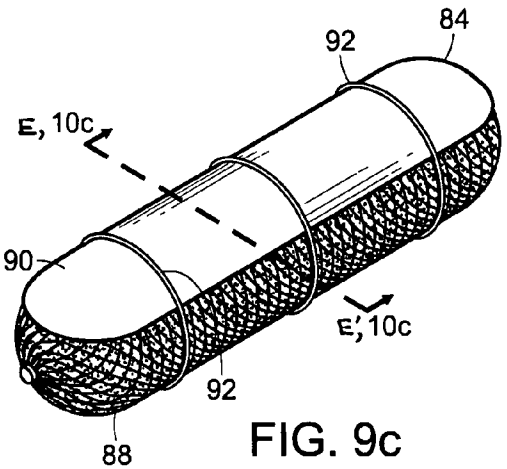
FIGS. 9*a-c* show perspective views of embodiments of the drainage units of the present invention with barrier layer affixed in position.
Figure 9B:
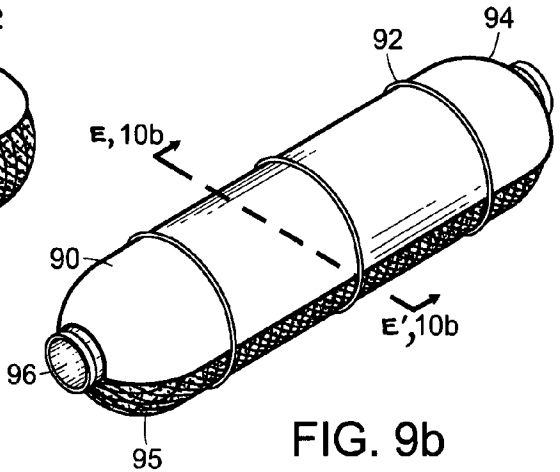
Figure 9A:
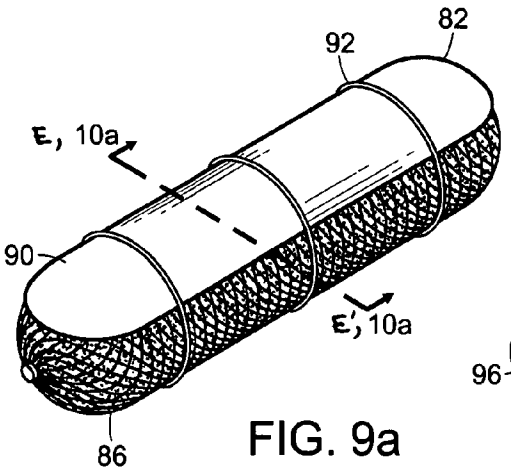

FIGS. 9*a-c* show additional features of embodiments of the drainage units of the present invention. FIGS. 9*a*, 9*c* show individual drainage units 82, 84 having sleeve members 86, 88 respectively filled with aggregate. Barrier material 90 is shown covering about one-third of the surface area of units 82, 84, with barrier material 90 held in place by retaining members 92. The barrier material 90, as shown, extends circumferentially about units 82, 84 to about 180° of the units 82, 84. It is understood that the barrier material may completely encase the unit, if desired, even comprising a region of circumferential overlap (greater than about 360° to about 380° of circumferential coverage). However, according to the present invention, the barrier material need not encase the unit to give superior drainage performance. FIG. 9*b* shows an embodiment of one type of drainage unit of the present invention, whereby a preferably perforated conduit 96 is disposed longitudinally through the length of unit 94. Barrier material 90, as shown, may extend circumferentially to about 180° of the unit 94 or any degree as desired up to and including completely encasing the unit even to the point of circumferential overlap (greater than about 360° to about 380°). It is likewise understood that the barrier material 90 may encase the unit circumferentially to a degree of from about 20° to about 380°, or less, such as, for example, preferably from about 60° to about 180°, etc. It is additionally understood that barrier material coverage patterns such as offset adjacent or overlapping spirals, etc., or even discontinuous coverage patterns may be used if such coverage patterns allow the units to yield adequate drainage properties, depending upon the contemplated drainage use.

Figure 10C:
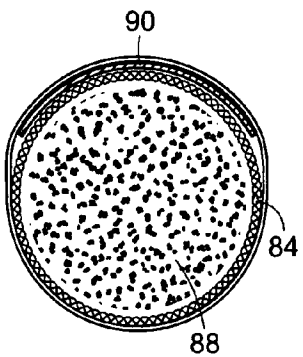
FIGS. 10*a-c* show cross-sectional views of the units shown in FIGS. 9*a*-9*c* taken along line E-E'.
Figure 10B:
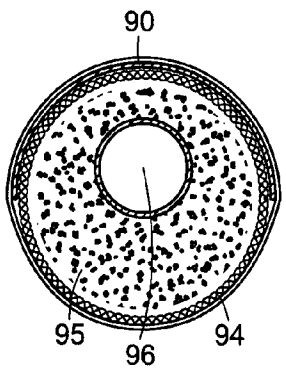
Figure 10A:
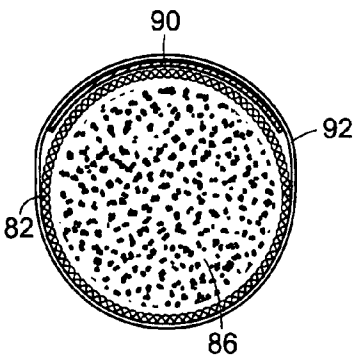

FIGS. 10*a-c* shows cross-sectional views of the units shown in corresponding FIGS. 9*a-c* across line E-E'. FIGS. 10*a* and 10*c* correspond to FIGS. 9*a* and 9*c*. FIG. 10*b* corresponds to FIG. 9*b*.

Figure 11C:
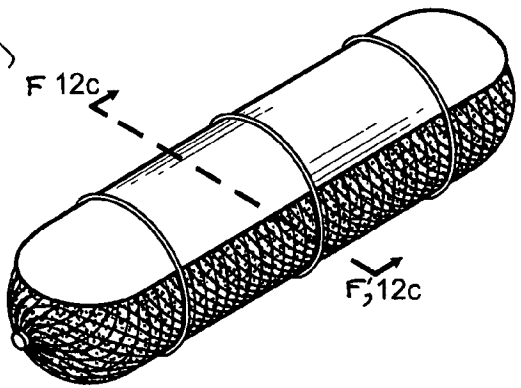
FIGS. 11*a-c* show perspective views of embodiments of the drainage units of the present invention with barrier layer affixed in position.
Figure 11B:
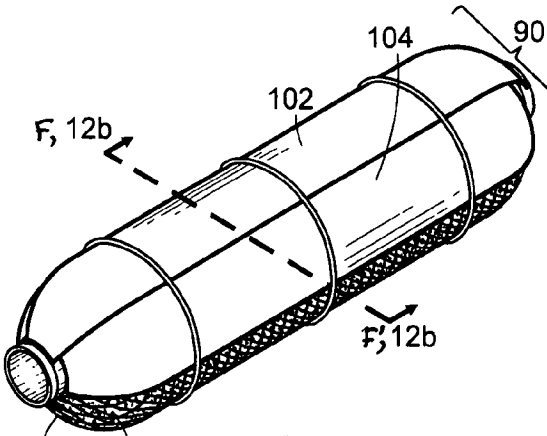
Figure 11A:
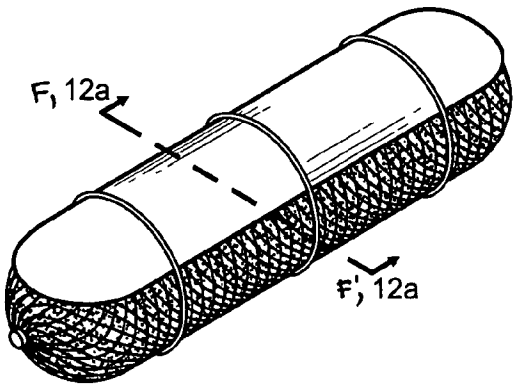
Figure 12C:
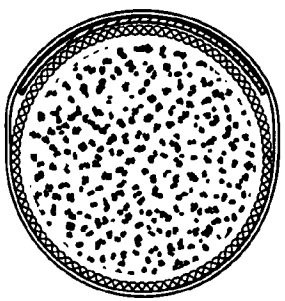
FIGS. 12*a-c* show cross-sectional views of the units shown in FIGS. 11*a-c* taken along line F-F'.
Figure 12B:
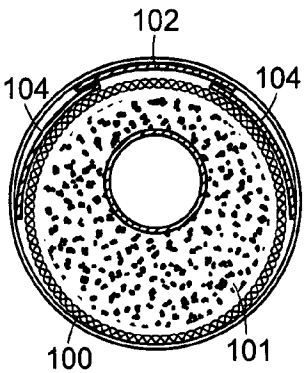
Figure 12A:
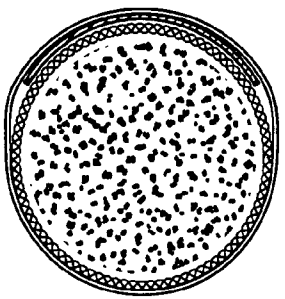

FIGS. 11*a-c* show additional features of embodiments of the drainage units of the present invention. More specifically, FIG. 11*b* corresponds to an embodiment of the drainage units of the present invention whereby the unit 100, comprises a barrier material placed in intimate contact with the sleeve member 54 that contains aggregate 56. As shown in FIG. 11*b*, the barrier material 90 may comprise multiple segments 102, 104, which cover multiple lengthwise-extending areas of the sleeve member and underlying aggregate. Such segments may comprise different physical characteristics, such that various, predictable drainage characteristics can be effected to suit a particular application to which the drainage unit is applied. That is, combining sections of barrier sheets having varying degrees of liquid permeability, may be advantageous and desirable in certain applications. Such "combination sheet" barrier materials could be more versatile than stocking many different types of barrier material in inventory, etc. Further reasons for providing a combination sheet include, for example, selective biodegradability, reinforcement properties, ability to promote or retard biological growth, etc. FIG. 12*b* is a cross-sectional view of the unit shown in FIG. 11*b* taken across line F-F'.

Figure 13:
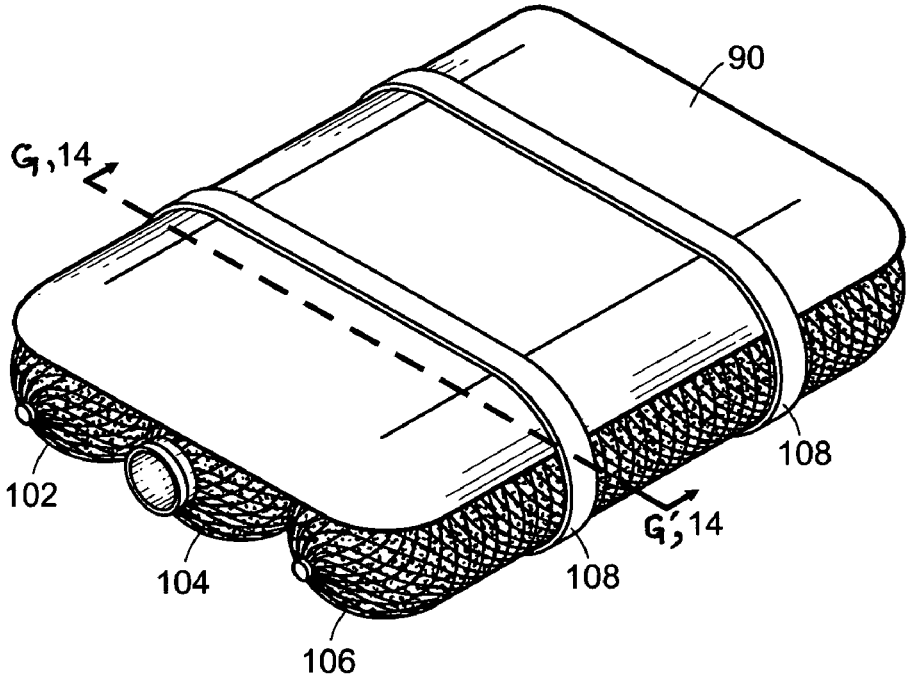
FIG. 13 shows a perspective view of one embodiment of the drainage units of the present invention.
Figure 14:
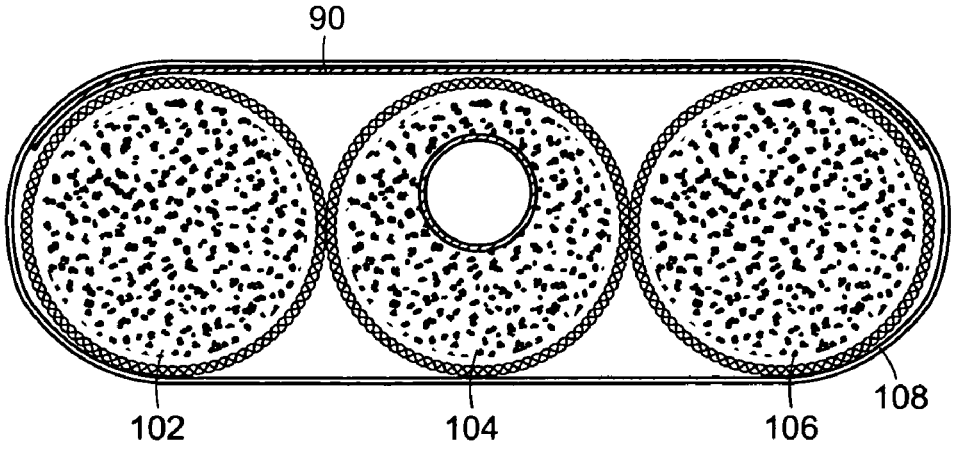
FIG. 14 shows a cross-sectional view of the unit shown in FIG. 13 taken along line G-G'.

FIG. 13 shows an embodiment of the drainage unit of the present invention whereby the barrier sheet 90 extends over multiple drainage units 102, 104, 106. Retaining members 108 may be of any useful dimension as desired, and may be made from any useful material (as discussed in more detail below), and may even figure prominently in the draining characteristics of the units they associate with. For example, the present invention contemplates that the selected retaining members may themselves be liquid permeable, or may not be permeable. Preferred non-permeable retaining members include, for example, plastic and nylon retaining members, and suitable banding material, or tape, etc. The present invention contemplates the use of a single or multiple retaining members as desired. Specifically, as shown in FIG. 13, the retaining members 108 are shown securing the barrier sheet 90 to multiple drainage units 102, 104, 106. It is further understood that the retaining single or multiple retaining members 108 can be used to secure barrier material individually to each drainage unit as shown in FIGS. 9-11. FIG. 14 is a cross-sectional view of the unit shown in FIG. 13 taken along line G-G'.

Figure 15C:
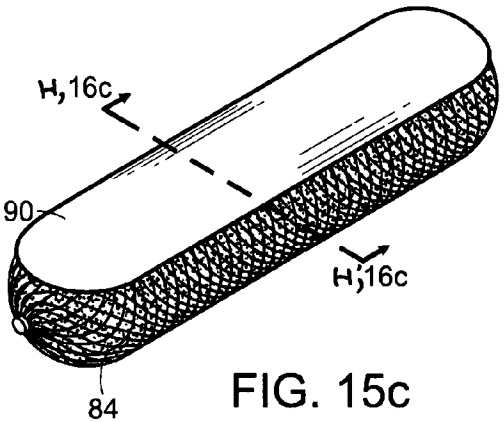
FIGS. 15*a-c* show perspective views of one embodiment of the drainage units of the present invention.
Figure 15B:
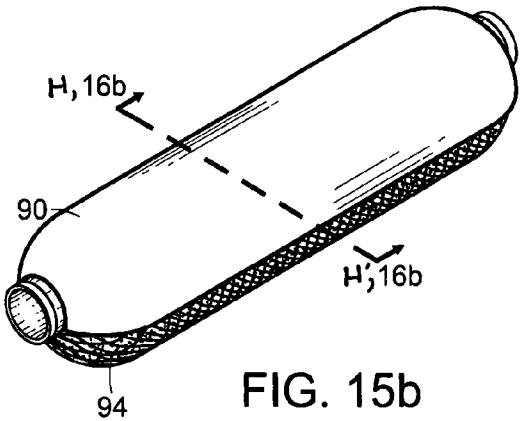
Figure 15A:
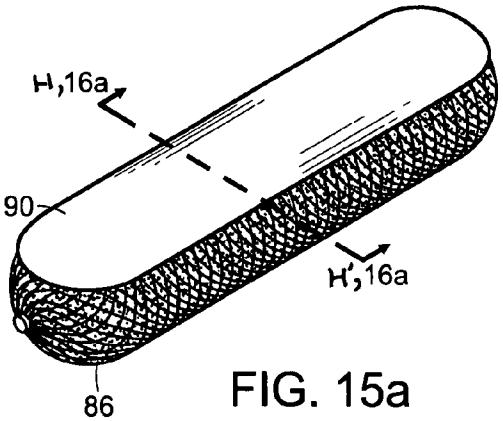
Figure 16C:
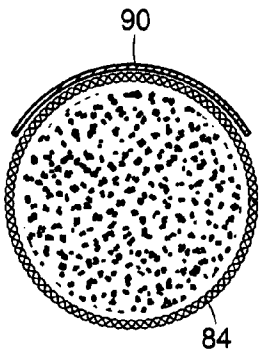
FIGS. 16*a-c* show cross-sectional views of the unit shown in FIGS. 15*a-c* taken along line H-H'.
Figure 16B:
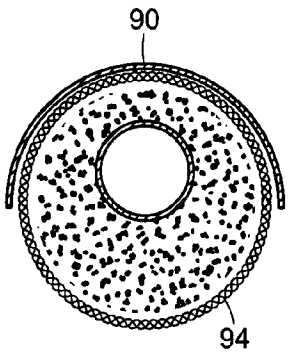
Figure 16A:
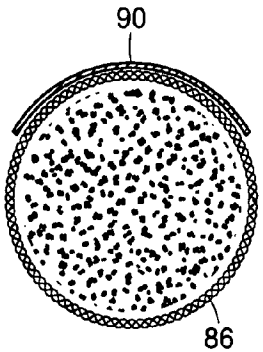
Figure 26A:
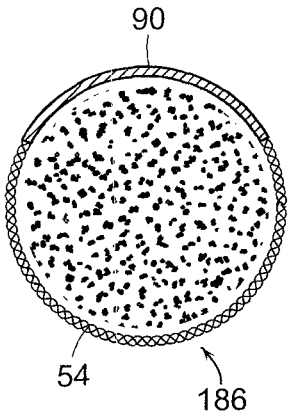
FIGS. 26*a-c* are cross sectional views like those of FIGS. 16*a-c*, showing a sleeve having an integral barrier.
Figure 26B:
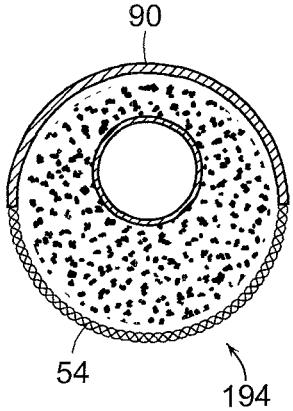
Figure 26C:
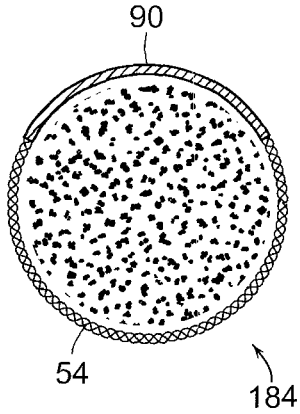

FIGS. 15*a-c* show a further embodiment of the drainage units of the present invention, whereby the barrier sheet 90 is affixed to the unit without the use of retaining members. FIGS. 16*a-c* are cross-sectional views of the units shown in FIGS. 15*a-c* taken across line H-H'. In this embodiment, the barrier sheet 90 is affixed to the sleeve member, or to the sleeve member and portions of the aggregate as desired. The affixation means can be an adhesive, or adhesive-type material as explained further herein, and the adhesive or adhesive type material can be applied to the underside of the barrier sheet, the exterior of the sleeve member, portions of the aggregate or combinations thereof. In addition, the barrier sheet 90 may be manufactured to be integrated into the sleeve member. That is, the barrier sheet 90 may constitute a portion of the sleeve member 54 and share responsibility with netting in retaining the aggregate. This is illustrated by the cross-sectional views of drainage units 184, 186 and 194 of FIGS. 26*a-c*, which are related to FIGS. 15*a-c*. As shown, the barrier comprises up to about one half of the circumference of the unit. The barrier is integrated into the sleeve, such that the sleeve and barrier interface in at least two different areas on the exterior of the unit. In this embodiment, the barrier sheet material 90 may be attached to the sleeve member via known techniques such as thermal bonding, or by any suitable means that would physically or chemically attach the barrier sheet material to the sleeve member material, the aggregate, an additionally provided material (not shown) and combinations thereof.

Figure 17:
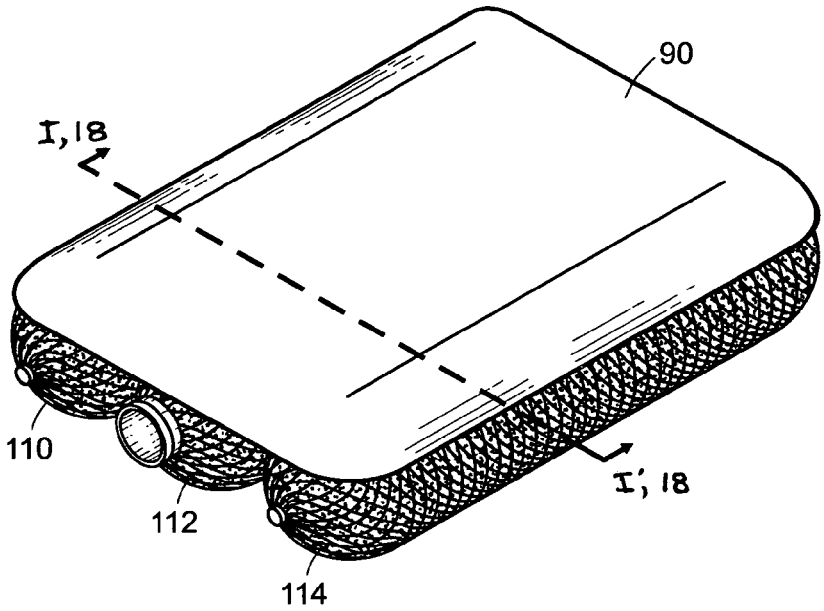
FIG. 17 shows a perspective view of one embodiment of the drainage units of the present invention.
Figure 18:
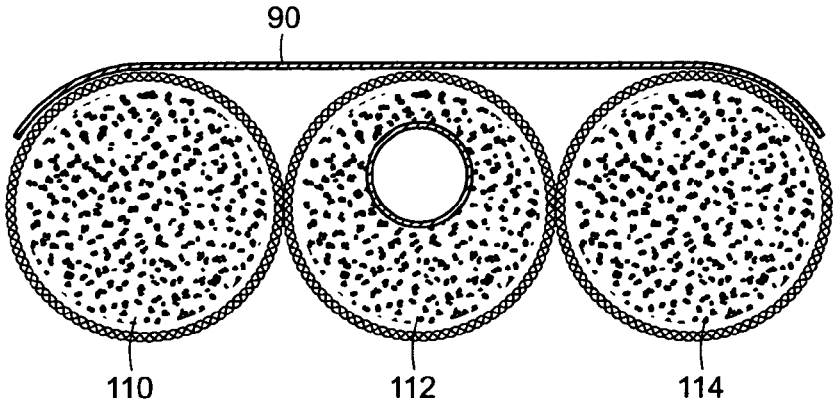
FIG. 18 shows a cross-sectional view of the unit shown in FIG. 17 taken along line I-I'.

FIG. 17 shows a further embodiment of the drainage units of the present invention, whereby barrier sheet 90 is affixed to multiple drainage units 110, 112, 114. In this embodiment no retaining members are employed. FIG. 18 is a cross-sectional view of the embodiment shown in FIG. 17 taken along line I-I' Note that barrier sheet 90, in this embodiment is only affixed to the "top" of the drainage units 110, 112, 114, and remains substantially planar across the "top" of the units. In other words, the barrier sheet does not conform to the contour of the plurality of drainage units.

Figure 19:
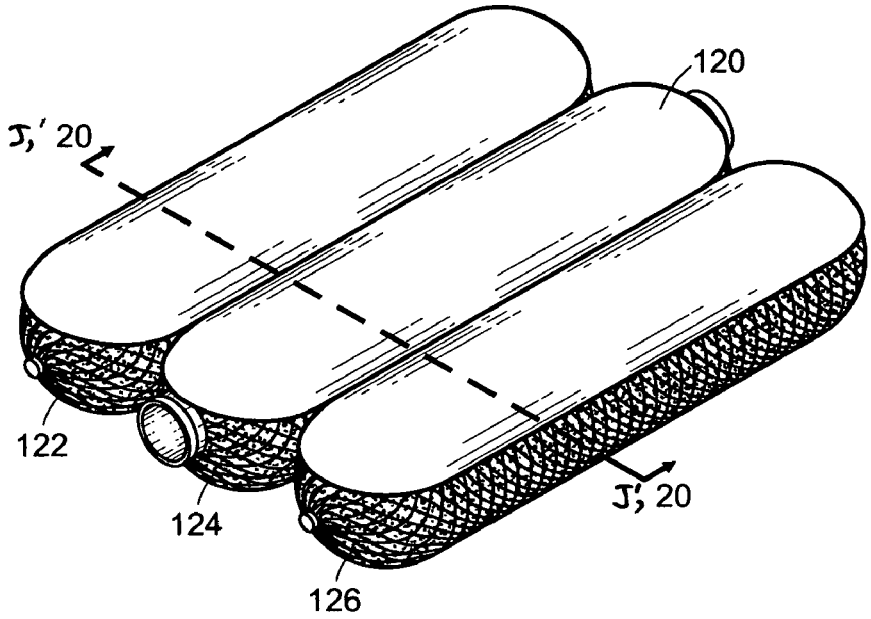
FIG. 19 shows a perspective view of one embodiment of the drainage units of the present invention.
Figure 20:
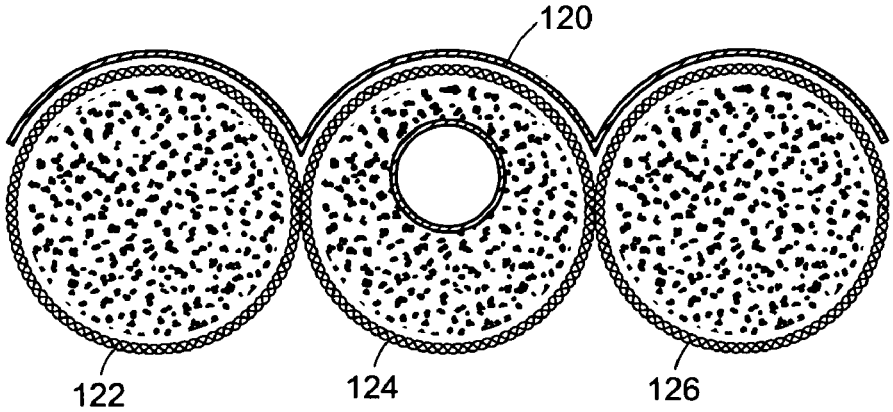
FIG. 20 shows a cross-sectional view of the unit shown in FIG. 19 taken along line J-J'.

FIG. 19 shows a further embodiment of the drainage units of the present invention, whereby a single barrier sheet 120 is either pre-shaped, or designed to conform to a greater circumferential surface area of each of the units 122, 124, 126. That is, the barrier sheet 120 is affixed to cover about 180° of each unit circumferentially. It is understood that the barrier sheet can be designed to affixedly cover any desired degree of the units. FIG. 20 is a cross-sectional view of the embodiment shown in FIG. 19 taken along line J-J'.

Figure 21:
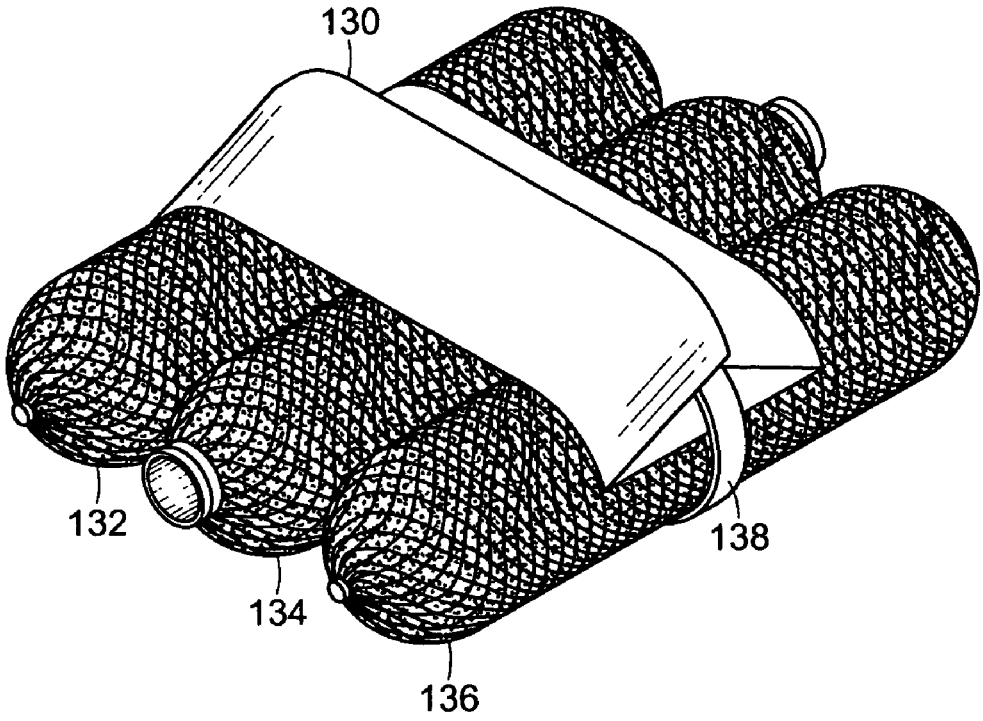
FIG. 21 shows a perspective view of one embodiment of the drainage units of the present invention with the barrier in a laterally folded position.

FIG. 21 shows a further embodiment of the drainage units of the present invention, whereby a single barrier sheet 130 is held in temporary position to units 132, 134, 136 by retaining member 138. As shown, this embodiment contemplates, for example, a means by which the drainage unit assembly may be shipped from the manufacturer to an end use on site. The barrier sheet 130 is folded as desired, and then, once the unit has been delivered to the end use site, the barrier material 130 may be unfolded longitudinally (or parallel), to its final position, substantially covering the bundled unit 140. It is understood that multiple barrier sheet segments could be retained by retaining members or otherwise partially affixed at the site of manufacture, and later expanded, such as, for example, by unfolding to their final position for use on site.

Figure 22:
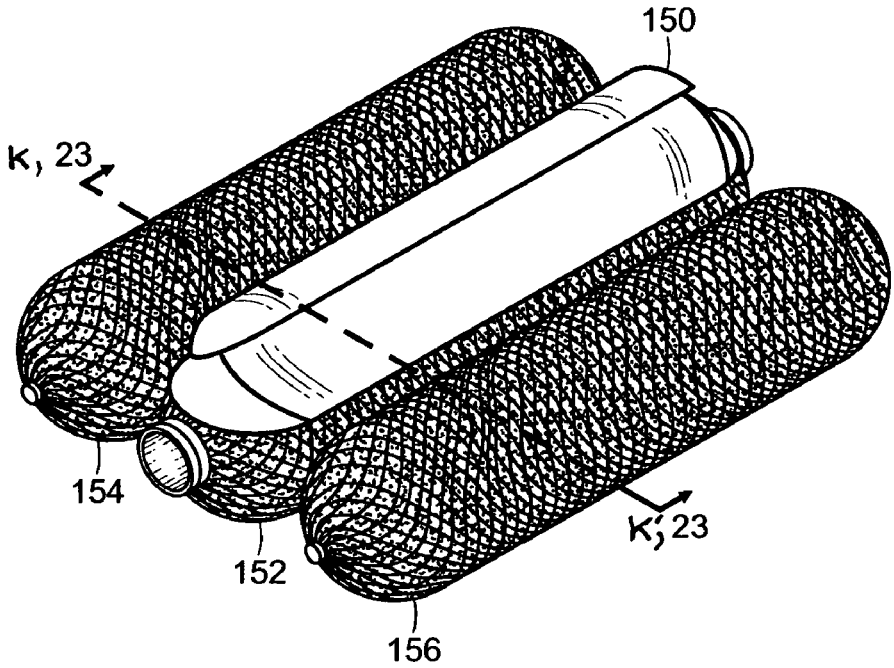
FIG. 22 shows a perspective view of one embodiment of the drainage units of the present invention with the barrier folded longitudinally.
Figure 23:
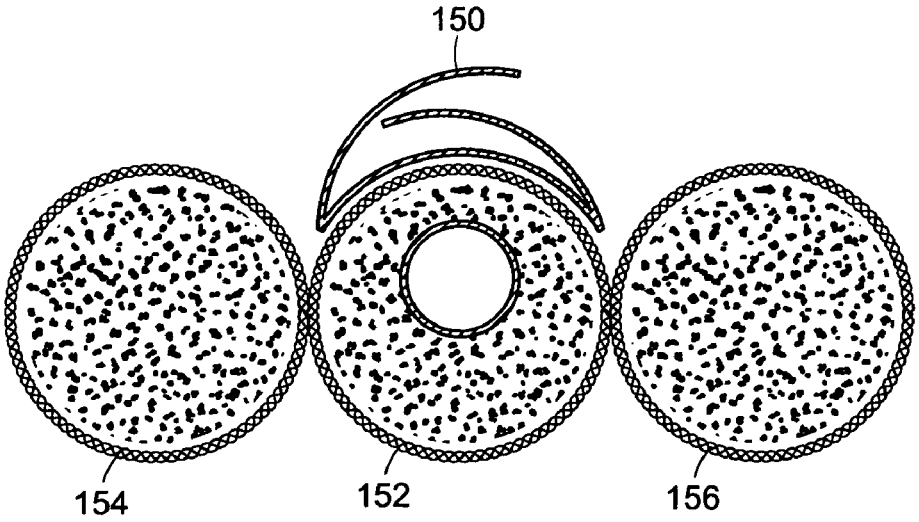
FIG. 23 shows a cross-sectional view of the unit shown in FIG. 22 taken along line K-K'.

FIG. 22 shows a further embodiment of the drainage units of the present invention, whereby a single barrier sheet 150 is found in temporary, folded, position about unit 152. In this embodiment, as shown, in tandem with the cross-sectional view shown in FIG. 23 (and taken along line K-K' in FIG. 22), the barrier sheet 150, may be unfolded laterally, or perpendicular to the longitudinal direction of the units themselves. In this way, the barrier sheet 150 can be unfolded to substantially cover the "top" of units 154 and 156 as well as centrally disposed unit 152, on which the barrier sheet 150 has been transported. While it is not shown, it is understood that the barrier sheet 150 may be affixed to the "tops" of units 152, 154 and 156 as desired. Further, as an additional step and feature, if desired, retaining members may then be used as primary or secondary affixation means to secure the barrier sheet to the units. In other words, retaining means such as those shown in FIGS. 9-14 and 21, for example, may be used as the primary affixation means used to secure the barrier sheet to the units. Alternately, such retaining means may be used in concert with other affixation means, such as an integrated or after-applied adhesive, to secure the barrier sheet to the units.

Figure 24A:
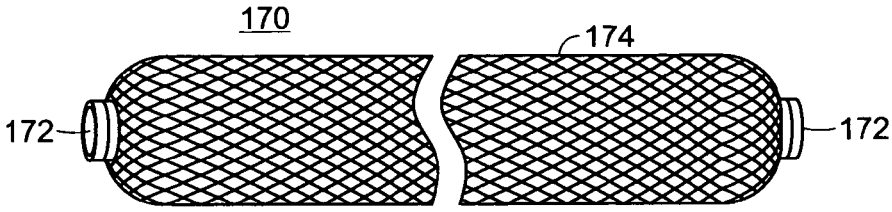
FIGS. 24*a-c* show perspective views of further embodiments of the present invention.
Figure 24B:
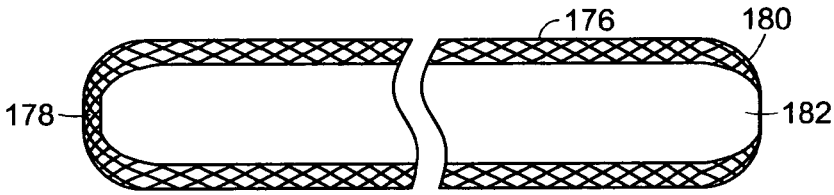
Figure 24C:
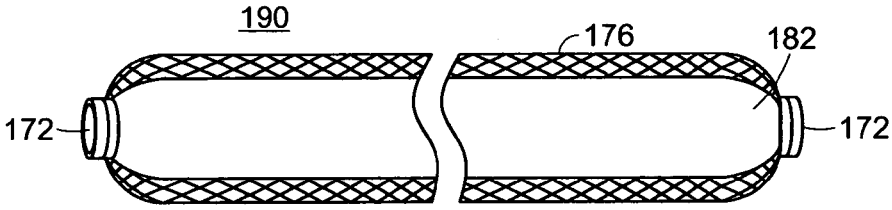
Figure 24D:
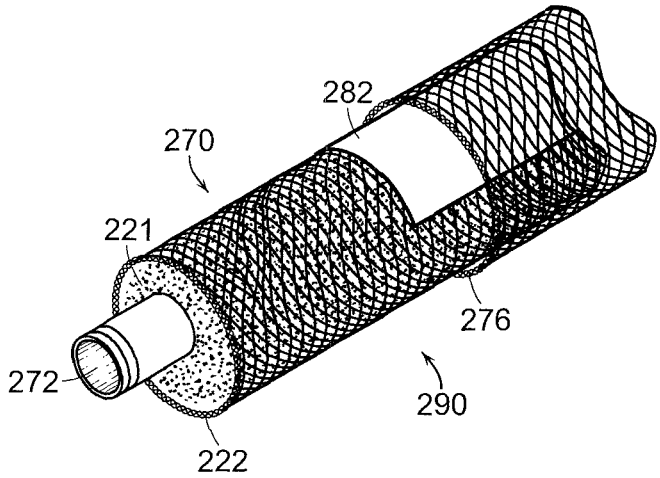
FIG. 24*d* is a further perspective view of the invention of FIGS. 24*a-c*.

FIGS. 24*a-c* and 25*a-c* show further embodiments of the present invention, whereby a drainage unit 170, 200 similar to the types shown in FIGS. 1 and 2 is inserted into another sleeve having a segment of barrier material attached. More specifically, FIG. 24*a* shows a drainage unit 170 comprising a conduit 172 with surrounding aggregate (not visible) encased by sleeve 174. FIG. 24*b* shows a sleeve 176 having openings 178, 180 into which the unit 170 is placed. It is understood that the circumference of unit 170 is just slightly less than the circumference of the sleeve 176 such that unit 170 is passed into the sleeve 176. It is understood that a useful variant of this embodiment may call for only one end of sleeve 176 to be open. Sleeve 176 comprises a barrier segment 182. FIG. 24*c* shows the final drainage unit 190 in its finished state of assembly. In one preferred embodiment, sleeve 176 is fitted and secured to the end of the conduit 172. It is also contemplated that sleeve 176 may be held in placed via friction fit, without physically securing the sleeve 176 to the ends of the unit 170 or ends of the conduit 172. Any adequate means to secure sleeve 176 to unit 170 is contemplated by the present invention, including, for example, thermal boding, shrink-wrapping, use of adhesives, gamma or other radiation, steam treatment, etc. FIG. 24*d* further illustrates this aspect of the invention. It shows drainage unit assembly 290 comprising two sleeves. The second or outer sleeve 276 fits onto the first-formed drainage unit 270. Unit 270 is like unit 170 and is comprised of aggregate 221 surrounding a conduit 272. The aggregate is contained within a first sleeve 222. Second sleeve 276, having barrier 282 affixed to a portion of its exterior, is shown partially enveloping unit 270. The arrow indicates how the outer sleeve is movable further onto the unit 270, to the left in the picture, to form the completed assembly 290. Alternately, the barrier may be affixed to the first sleeve 222 and the second sleeve may have no barrier.

Figure 25A:
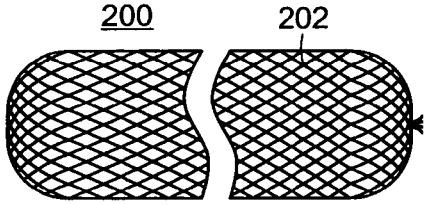
FIGS. 25*a-c* show perspective views of further embodiments of the present invention.
Figure 25B:
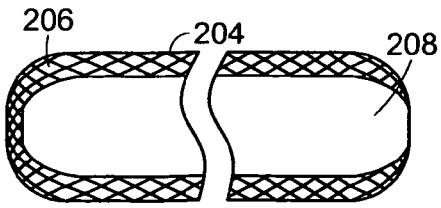
Figure 25C:
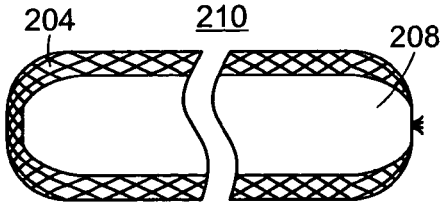

FIGS. 25*a-c* show a variation of the unit shown in FIGS. 24*a*-24*c*. FIG. 25*a* specifically shows a drainage unit 200 that does not have the conduit 172 in place. In this embodiment, drainage unit 200, comprising an aggregate filled sleeve 202 (FIG. 25*b*), is inserted into sleeve 204 comprising at least one open end 206 and a barrier segment 208. The completed drainage unit 210 is shown in FIG. 25*c*, having sleeve 204 with barrier segment 208 encasing unit 200 (no longer visible). The formerly open end of sleeve 204 has been closed by known sealing means as would be readily apparent to one skilled in the plastics and packaging fields. As with the unit shown in FIGS. 24*a-c*, sleeve 204 and unit 200 are appropriately dimensioned to ensure that unit 200 may be inserted into sleeve 204, and that sleeve 204 is likewise adequately secured to unit 200, by any appropriate means as stated above, and as would be readily apparent to one skilled in the plastics and packaging fields. It is understood that, although not shown, according to a contemplated embodiment off the present invention, the barrier material could be incorporated into the first sleeve, instead of, or in addition to, the presence of barrier material associated with the second sleeve as shown According to preferred embodiments of the present invention, the barrier sheet material is preferably treated, alone or in conjunction with the treating of the exterior of the sleeve netting material, to achieve a pre-selected and fixed orientation on the exterior of the sleeve netting material. In one embodiment of the present invention, a bead or plurality of beads of suitable affixing material, including, but not limited to adhesives, may be supplied to the exterior of the drainage unit (netting sleeve exterior and random aggregate exterior that may be exposed) with the barrier sheet then supplied to the production line resulting in the pre-selected and predictably fixed, desired barrier sheet placement.

In another embodiment, an adhesive is supplied to the underside of the barrier sheet as it is supplied from, for example, a roll or plurality of rolls, for example, delivered on a web to the production line of the drainage units. The sheet with supplied affixing material is then presented to the sleeve netting surface of the drainage unit for final placement.

In still another embodiment, the barrier sheet, the aggregate, or the sleeve netting, or any combination thereof, may be treated such that the barrier sheet, the sleeve netting, the aggregate, or any combination thereof, are exposed to a change, such as a thermal or other change to activate a portion of their surfaces to result in a bonding, such as, for example, thermal bonding. It is contemplated that the sleeve netting, the barrier sheet, the aggregate, or any combination thereof, may first have at least one surface treated with a thermally or chemically reactive coating to facilitate bonding. In the case of a liquid permeable barrier sheet, any such treatment must not impede the liquid permeability characteristics important to its function and usefulness.

It is further contemplated that the barrier material is positioned, retained and otherwise secured to the unit via physical positioning means including, but not limited to, straps of any useful material that may be supplied separately, or that may be integral to another feature of the drainage unit of the present invention, such as, for example, the sleeve or the barrier material.

Still further, the positioning, retaining and securing of the barrier material on the unit may be effected by use of an additional sleeve member designed and dimensioned to overlay the first sleeve member. In these embodiments, the barrier material may be a part of the first or second sleeve, or both. Therefore, in these embodiments, it is understood that the barrier material may be positioned on the exterior of the unit (on top of the second sleeve), or may be positioned between the two sleeves. Design, end use and manufacturing considerations may dictate how the barrier is positioned, retained and otherwise secured to the unit, and multiple securing method may be employed.

The extent to which the drainage unit is covered by the barrier sheet is dependent only on its desired end use in the field. That is, the present invention contemplates presenting barrier sheet material coverage of the drainage unit to any desired percentage. In one embodiment, viewing the unit from a substantially circular cross-sectional perspective, and viewing the device as having exterior coverage in terms of up to 360 degrees (substantially equivalent to substantially complete coverage), the preferred, desired barrier sheet coverage of the unit is preferably from about 20 degrees to about 380 degrees (overlap is achievable), depending upon the desired end use or other constraints.

As described in the '924 patent, the liquid permeable barrier sheet may be constructed of any suitable pliable water permeable sheet material such as paper or cloth, but is preferably a geo-textile material such as nylon having a fine weave to block the passage of solids such as sand or dirt, but remain sufficiently permeable to allow the passage of water and fluids therethrough, preferably at a predictable and preselected rate. The barrier sheet may be of any desired thickness. The barrier sheet may be very thin to readily conform to the shape of the unit, which is preferably cylindrical, or the barrier sheet may be of a thickness as desired to provide rigidity to the unit for desired applications. The non-permeable barriers sheets are made from any suitable material that is impervious to liquids. Preferred non-permeable barrier sheets are made from plastics as would be readily understood by one skilled in the field of liquid impervious materials.

The aggregate is preferably made from lightweight plastic pieces (e.g. plastic puffballs, chips, cubes, etc.), and is preferably crush-resistant, blown polystyrene pieces of any desired shape selected to predictably facilitate the liquid throughflow drainage features of the resulting drainage units.

The sleeve netting is preferably a seamless plastic mesh tube of construction netting with an expandable diameter of variable size, for example, of from about 12 inches up to about 36 inches or more. However, it is understood that a plastic or other useful material can be selected to stretch or shrink to any conceivable desired unit diameter, dependent only on the requirements of the end use of the drainage unit in the field. The sleeve material may be provided to the manufacturing methods and apparatuses of the present invention substantially continuously as, for example, a roll, or may be supplied in individual, pre-dimensioned segments, as desired.

As is shown in the Figures, the drainage units of the present invention may or may not comprise a perforated conduit, or pipe component, depending on the end use field requirements of the drainage units.

The placement of the barrier sheet on the exterior of the drainage unit further allows for production flexibility, in that, the barrier sheet can be added to the unit either during fabrication of the unit, or at some later time, with the sheet added as an "after-market" accessory. This ability to attach the sheet to the unit at a later time, further allows for inventoried stock to be retro-fitted with the barrier sheet to any barrier sheet coverage specification, as desired.

If the barrier sheet is to be applied to the drainage unit during unit assembly and production, apparatuses such as those set forth in the '924 (more specifically at Cols. 4 and 5 of the '924 patent) are contemplated. It is recognized that the description of apparatuses must be modified somewhat to arrange the supply of barrier sheet material, such that the sheet material is supplied to the exterior of the sleeve netting, and that the production line may comprise a station directed to the affixation of the barrier sheet material to the sleeve netting, particularly the exterior surfaces of the sleeve netting and/or aggregate.

As stated above, it is further possible, that the aggregate surface could be treated during or after the drainage unit production, either alone or in combination with the treatment of the sleeve netting and on the surface of the barrier material to contribute to the bonding of the sheet material to the exterior of the of the drainage unit. This would depend upon the mesh of the netting used and the relative direct exposure of the aggregate to a surface of the barrier material. Such treatments include any treatments to alter the surface structure of the unit components such that temporary or permanent bonding of the barrier sheet to exterior of the unit is realized, as desired for any desired or pre-selected use of the unit in the field. Contemplated treatments include, but are in no way limited to, thermal treatments using either heat or cold, chemical treatments, corona or other plasma treatments or other surface changing treatments, additional laminations or adhesive treatments, radiation, steam, etc.

In addition, regulatory requirements for the finished drainage unit may require the use of inert materials. In this instance, molten forms of material not conventionally thought to be adhesives may by used. Various inert plastics, silicones, silicone-containing materials, etc. may be used applied to the interface of the barrier sheet material and the exterior of the drainage unit. That is, the inert material may be a laminate or may be a sporadically applied material to any combination of the sleeve material, the aggregate or the barrier sheet material, or may be applied to any one of the components to achieve the desired degree of affixation of the sheet material to the drainage unit exterior.

In a still further embodiment, the present invention also contemplates the production of drainage units comprising the aggregate as stated herein, but having a combined sleeve netting and barrier material applied to contain the aggregate in a single step and as a substantially single material. In this embodiment, the barrier material may be bonded to the sleeve material as would be readily understood by one skilled in the field of material bonding. In other words, in this embodiment, the sleeve netting may only comprise a degree of circumferential coverage of the aggregate of less than 360°, with the barrier material alone being responsible for the balance of the circumferential coverage. In one preferred embodiment, the sleeve netting has a coverage of from about 340° to about 20° and the barrier material has a complimentary coverage of from about 20° to about 340°.

With reference again to the Background and U.S. Pat. No. 6,854,924, the drainage units described above can be used in a variety of applications. For example, drainage units are buried in soil to form a drainage system which comprises a field which receives effluent that is discharged from a septic tank.

The invention may be embodied in other specific forms without departing from the spirit or essential characteristics thereof. The present embodiments are therefore to be construed in all respects as illustrative and not restrictive, the scope of the invention being indicated by the claims set forth below rather than by the foregoing description. All changes which come within the meaning and range of equivalency of the claims are therefore intended to be embraced therein.

I claim:

1. A pre-assembled drainage unit having a generally cylindrical shape, an exterior surface, a circumference, and a length, for burial in soil which is in contact with the exterior surface of the drainage unit, comprising:

a sleeve longitudinally extending along a portion of the length of the exterior surface of said cylindrical drainage unit, the sleeve comprised of a combination of netting and a first portion of barrier sheet;

wherein, the barrier sheet is made of water permeable material resistant to passage of fine solids and has (a) said first portion extending lengthwise and circumferentially, thereby forming a portion of the exterior surface of the drainage unit; and (b) two movable second portions, each second portion running along an opposing lengthwise side of the first portion as a flap which is foldable laterally with respect to the lengthwise direction of the drainage unit; and, lightweight aggregate contained within the sleeve.

2. The drainage unit of claim 1 wherein said netting underlies the barrier and wholly contains the aggregate; and, wherein the first barrier sheet portion is attached to the exterior of the netting.

3. The drainage unit of claim 2, wherein the barrier is attached to the sleeve by means selected from the group consisting of physical attachment, adhesive means, thermal treatment, chemical treatment, and combinations thereof.

4. The drainage unit of claim 2 wherein the barrier sheet first portion extends between 60 and 180 degrees circumferentially around the exterior of the drainage unit.

5. The drainage unit of claim 2 wherein the barrier sheet first portion extends at least 180 degrees around the generally cylindrical exterior surface.

6. The drainage unit of claim 1 wherein said netting forms a first circumferential part of the exterior of the drainage unit; wherein said barrier sheet first portion forms a second circumferential part of the exterior of the drainage unit; and, wherein the netting and barrier sheet first portion are integrated to each other, to contain said aggregate.

7. The drainage unit of claim 6 wherein the first portion of the barrier sheet extends between 60 and 180 degrees circumferentially around the exterior of the drainage unit.

8. The drainage unit of claim 6 wherein the barrier sheet first portion extends at least 180 degrees around the generally cylindrical exterior surface.

9. The drainage unit of claim 1 wherein said barrier sheet first portion and netting are integrated into each other at two lengthwise extending areas.

10. The drainage unit of claim 1 further comprising: a perforated pipe running lengthwise within the aggregate.

11. A drainage system comprising one or more drainage unit assemblies of claim 1.

12. A drainage unit having a generally cylindrical shape, an exterior surface, a circumference, and a length, for burial in soil which is in contact with the exterior surface of the drainage unit, comprising:

netting longitudinally extending along a portion of the length of the exterior surface of said generally cylindrical shape drainage unit, the netting forming a first circumferentially extending part of the exterior surface of the drainage unit;

water permeable barrier sheet longitudinally extending along a portion of the length of the generally cylindrical exterior surface, said barrier sheet attached to the netting, for resisting passage of fine solids from the exterior of the drainage unit;

the barrier sheet having a first portion which alone forms a second circumferentially extending part of the exterior surface of the drainage unit;

wherein, said first circumferential netting part and said second circumferential barrier sheet part additively form the total circumferential surface of the unit;

wherein said barrier sheet first portion has opposing lengthwise running sides and opposing ends running transverse to the length of the drainage unit;

wherein, the netting and the barrier sheet first portion are integrated with each other to form a circumferential structure for circumferentially containing aggregate; and, lightweight aggregate contained within the circumferential structure comprised of said integrated sleeve and barrier sheet;

wherein, said barrier sheet further comprises two moveable flap portions, each flap portion running lengthwise along an opposing side of said barrier sheet first portion and having a free end which is foldable laterally with respect to the length of said exterior surface of the drainage unit.

13. The drainage unit of claim 12 further comprising: a perforated pipe running lengthwise within the aggregate.

14. A drainage system comprising one or more drainage units of claim 12.

15. A drainage unit assembly comprised of a set of three horizontally adjacent and parallel generally cylindrical drainage units positioned lengthwise within a trench in soil, each drainage unit having an upward facing surface; wherein one unit of said set of three units is the center drainage unit, said center drainage unit lying between the other two of the three units of the set; each drainage unit of said set of three units comprising aggregate contained within netting; wherein, said center drainage unit is a drainage unit of claim 1, said center drainage unit comprising a barrier sheet having two movable second sheet portions.

16. The drainage assembly of claim 15, wherein each of said second movable sheet portions of the center drainage unit extends laterally from and lies on an upward facing surface of one of said adjacent drainage units.

17. The drainage assembly of claim 15 further comprising: a perforated pipe running lengthwise within the aggregate of at least said center drainage unit.

18. The drainage assembly of claim 15 wherein each of said sheet movable portions of the center drainage unit is sufficient in size to extend laterally from the center drainage unit to at least the highest elevation part of the upward facing surface of at least one of the other two drainage units of said set which is horizontally adjacent to said center drainage unit.

19. The drainage assembly of claim 15 wherein all three drainage units have the same construction as said center drainage unit.

20. A drainage system comprising one or more drainage units of claim 15.

21. A method of treating effluent from a septic tank within soil which comprises (a) providing a generally cylindrical first drainage unit having an exterior surface, an interior, and a length, the drainage unit comprised of (i) a longitudinally extending sleeve of netting having a length lying along the length of the first drainage unit;

(ii) plastic aggregate contained within the sleeve; and, (iii) a barrier sheet having a first fixed portion attached to or integral with the sleeve of netting in the circumferential and lengthwise directions, to thereby form a portion of the exterior surface of the first drainage unit, for resisting the passage of any fine solids within the soil from the exterior of the first drainage unit into the aggregate contained within the sleeve, and two movable barrier sheet second portions, each running along an opposing lengthwise side of said first fixed portion;

wherein said opposing side second portions of said barrier sheet have free ends which are unattached to the first drainage unit and which are foldable with respect to the length of the first drainage unit;

(b) placing the first drainage unit within a trench so it lies between and parallel to second and third drainage units and so the fixed portion of the barrier sheet of the first drainage unit is facing upwardly as the drainage unit lies in the trench; and (c) folding each of said opposing side movable barrier sheet second portions so the free end of each extends outwardly from the first drainage unit and rests on one of said second or third drainage units.

22. The method of claim 21 wherein said first drainage unit comprises a perforated pipe running lengthwise within said aggregate.

23. The method of claim 21 wherein the first drainage unit further comprises a length of perforated conduit, positioned within the interior of the first drainage unit, the conduit having a length which is greater than the length of the sleeve.

24. The method of claim 21 wherein step (b) comprises providing and placing second and third drainage units which are free of barrier sheets.

* * * * *